United States Patent [19]

Wright

[11] 4,034,882

[45] July 12, 1977

[54] CONTAINER CLOSURES

[75] Inventor: Garth Wright, Greenford, England

[73] Assignee: Rockware Group Limited, England

[21] Appl. No.: 732,790

[22] Filed: Oct. 15, 1976

[30] Foreign Application Priority Data

Oct. 15, 1975 United Kingdom ..... 42322/75

[51] Int. Cl.[2] ..... B65D 55/02; B65D 85/56; A61J 1/00

[52] U.S. Cl. ..... 215/217

[58] Field of Search ..... 215/217, 220

[56] References Cited

U.S. PATENT DOCUMENTS

| | | | |
|---|---|---|---|
| 3,741,421 | 6/1973 | Wittwer | 215/217 |
| 3,888,376 | 6/1975 | Cooke | 215/217 |

*Primary Examiner*—George T. Hall

*Attorney, Agent, or Firm*—Leydig, Voit, Osann, Mayer & Holt, Ltd.

[57] ABSTRACT

A "childproof" container closure comprises a threaded neck member and a threaded closure cap or plug member cooperating therewith. One member bears a raised helical thread having a stop end and the other member defines two helical paths in which the helical thread may be engaged, one of which paths allows the cap or plug member to be removed from the neck member and the other having at its end a blocking member adapted to engage the stop end of the helical thread. The cap or plug can be resiliently sprung axially to move the raised helical thread from one helical path to the other.

13 Claims, 5 Drawing Figures

CONTAINER CLOSURES

This invention relates to container closures.

While the present invention is particularly applicable to bottle closures wherein the bottle neck is closed by a cap it will be evident that it may be applied to analogous containers such as jars. For simplicity however it will be specifically described in relation to bottles.

In recent years much attention has been directed to the production of so-called "child-proof" closures. These are for use in containers containing noxious substances such as drugs or bleach, away from which children should be kept for their own safety. In recent years a variety of complex constructions have been devised for the purpose which generally require ingenuity or strength beyond that of the average child in order to open the container. The complexity of many of these systems gives rise to disadvantages in manufacture and consequent economic disadvantage. In addition in many cases both container and its closure member need to be specially modified.

According to the present invention there is provided a container closure comprising a threaded neck member and a threaded closure cap or plug member cooperating therewith, one such member bearing a raised helical thread having a stop end and the other member defining two helical paths in which the helical thread may be engaged, one of which paths allows the cap or plug member to be removed from the neck member and the other having at its end a blocking member adapted to engage the stop end of the helical thread, and wherein the cap or plug member can be resiliently sprung axially to move the raised helical thread from one helical path to the other.

The container closure of the invention accordingly consists as to one member simply of a cap, plug or container neck having a raised helical thread. This is customary for engagement with normal threaded closures and accordingly a principal advantage of the invention is that it can be used on containers having conventionally threaded necks with a raised helical thread thereon. The most widely used form of such container is one in which the helical raised thread is external of the neck and in such a case the other member is a cap the inside of which defines the two helical paths. This is the preferred form of the invention though it will be appreciated that the invention is equally applicable to containers having an internally threaded neck which require a plug having on its external surface means defining the two helical paths and it is also possible to have the raised helical thread on the cap or plug and the means defining the two helical paths formed on the container neck, externally or internally respectively.

When such a container is closed, the cap or plug is screwed on to the neck member with the helical thread engaging in the free helical path. As the thread is tightened, axial forces arise in the usual way due to the abutment of part of the cap or plug member with part of the neck member and as turning is continued these act to spring the two members axially to move the helical thread into the closed path. The cap or plug member can now be rotated on the neck member with the helical thread engaging the blocked path and removal of the cap or plug is prevented by engagement of the end of the raised helical thread with the blocking member. Such engagement need not, and indeed preferably should not, generate any axial forces tending to spring the helical thread axially.

Preferably the axial force needed to spring the raised helical thread from the free path to the blocked path is considerably smaller than that required to spring it from the blocked path to the next turn of the free path, the latter being preferably so great that such a second resilient springing step cannot be effected without breakage of the container or cap or plug member. This may be achieved by defining the helical paths by helical ribs of differing heights each side of the blocked path. The resilience should be such as to enable springing over the lower rib but not over the higher.

Closures according to the invention can be opened by rotating the cap or plug until the end of the raised helical thread meets the blocking member, and then pushing the cap or plug member axially to spring the raised helical thread back into the free path, whereafter the cap or plug may be unscrewed in the usual way.

It will be appreciated that the specific dimensions and materials of the cap or plug member and the neck member will determine the degree of ease with which the helical thread may be sprung from one path to the other. Generally it is convenient to make the neck member of rigid material such as rigid plastics or glass and to make the cap member relatively flexible; materials such as polypropylene, polyethylene and polystyrene are particularly suitable, but the cap member can also be made e.g. of metal if the shape and wall thickness enable the necessary resilient springing action.

Conventional resilient sealing means to seal the cap or plug member and neck member together for use on containers containing liquids may be embodied in the usual way.

The invention is illustrated by way of Example with reference to the accompanying drawings, in which.

Figure 1:
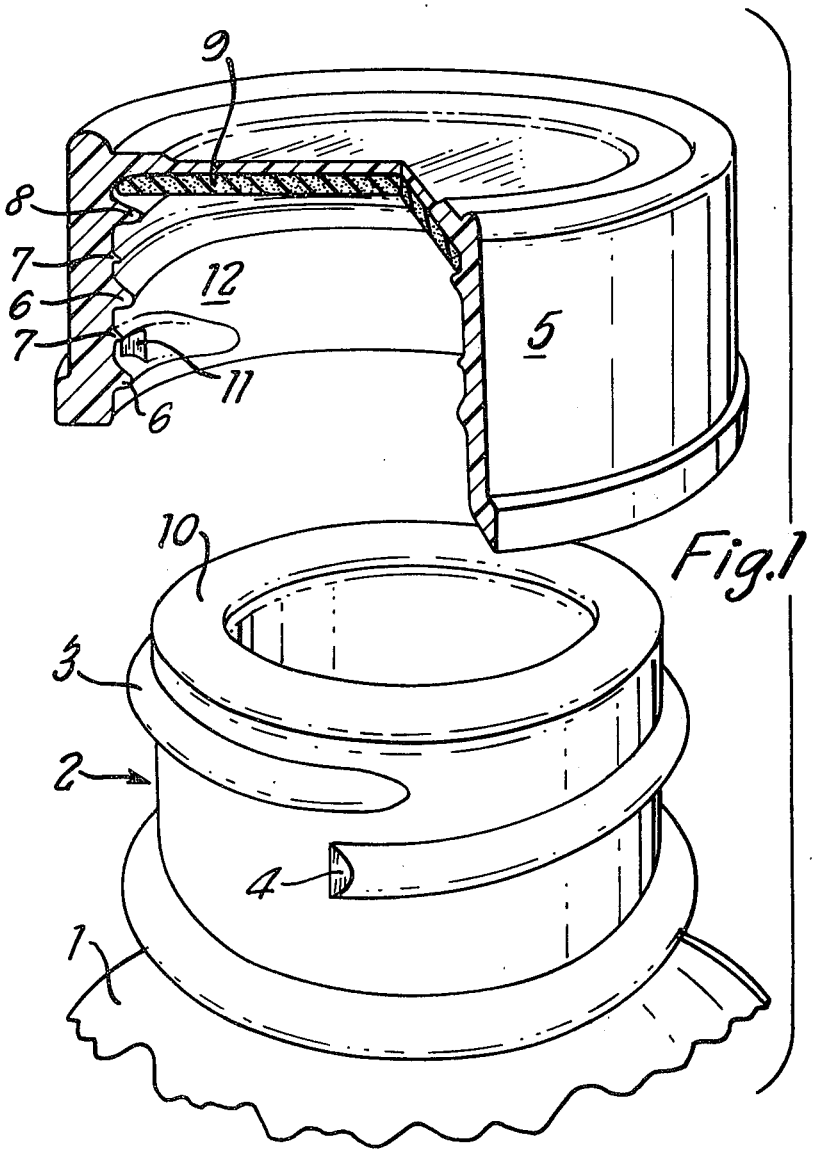
FIG. 1 is an exploded view of a closure according to the present invention, part of the cap being cut away.

Referring to the drawings a glass container 1 has a neck 2 which bears on its exterior a raised helical thread 3 one end of which has a stop surface 4.

A resilient polypropylene cap 5 is provided on its interior with 2 helical ribs 6 and 7, rib 6 being higher relative to the cylindrical inner surface of the cap 5 than rib 7. The interior of the cap also has a raised circular wad retaining feature 8 adapted to engage the cylindrical outer surface of neck 2 and a wad 9 adapted to engage the top surface 10 of the bottle neck 2. At a point near the open end of cap 5, ribs 6 and 7 merge with the formation of an intermediate blocking member having a face 11.

Figure 2:
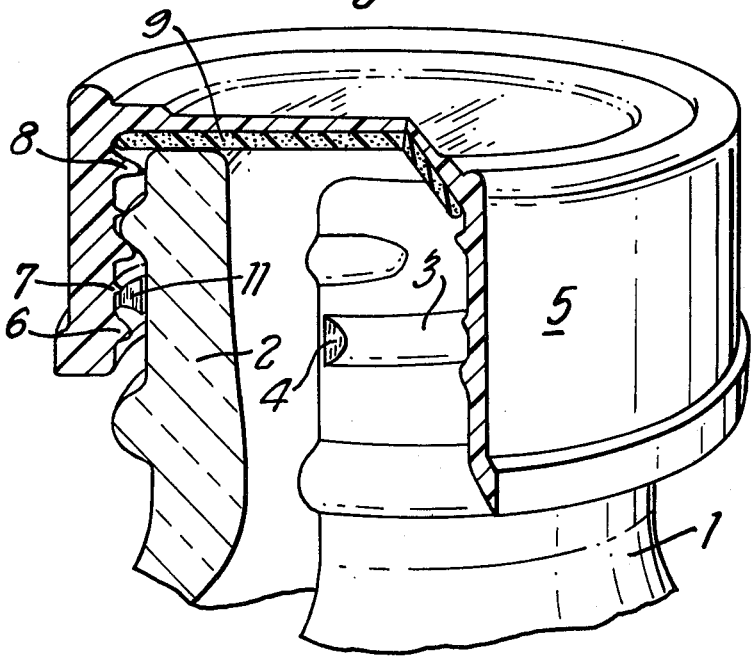
FIG. 2 is a part cut away view of the closure of FIG. 1 with the cap and neck interengaged.
Figure 3:
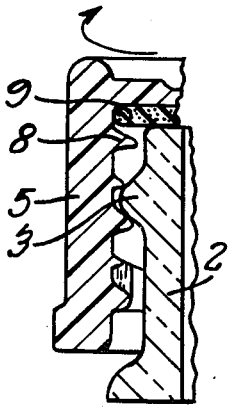
FIGS. 3, 4 and 5 are part axial sections through the cap and neck at various stages during the removal of the cap.

As cap 5 is screwed on to neck 2, helical thread 3 initially engages at area 12 and runs up the free path between the smaller rib 7 below it and the higher rib 6 above it. When wad 9 abuts surface 10, as screwing up is continued an axial force is generated which springs the helical thread 3 over rib 7 into the path between the two helical ribs 6 and 7. This is the position shown in FIG. 2.

Figure 4:
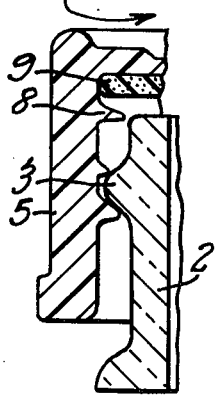
Figure 5:
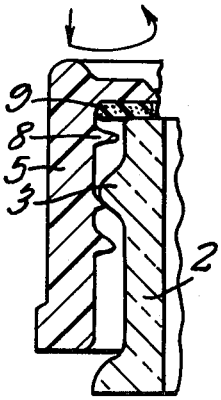

If an attempt is now made to unscrew the cap, unscrewing can proceed only for a short while until the end 4 of the helical thread abuts the blocking surface 11 between ribs 6 and 7. Such abutment gives rise to no axial forces tending to spring the cap 5 axially relative to neck 2 and provided that the fit between cap and neck is good enough, the cap cannot now be further unscrewed. This is the position shown in FIG. 4. In order to open the container, the cap 5 is now pushed firmly downwards relative to the container which springs the helical rib 3 over the lower rib 7 to the position shown in FIG. 5. The helical rib 3 is now in the free path and the cap can be unscrewed in customary fashion without difficulty.

I claim:

1. A container closure comprising a threaded neck member and a threaded closure cap member cooperating therewith, one such member bearing a raised helical thread having a stop end and the other member defining two helical paths in which the helical thread may be engaged, one of which paths allows the cap member to be removed from the neck member and the other having at its end a blocking member adapted to engage the stop end of the helical thread, and wherein the cap can be resiliently sprung axially to move the raised helical thread from one helical path to the other.

2. A container closure according to claim 1 wherein the neck member bears an external helical raised thread and the inside of the cap defines the two helical paths.

3. A container closure comprising a threaded neck member and a threaded closure plug member cooperating therewith, one such member bearing a raised helical thread having a stop end and the other member defining two helical paths in which the helical thread may be engaged, one of which paths allows the plug member to be removed from the neck member and the other having at its end a blocking member adapted to engage the stop end of the helical thread, and wherein the plug can be resiliently sprung axially to move the raised helical thread from one helical path to the other.

4. A container closure according to claim 3 wherein the container has an internally threaded neck, and the plug member has on its external surface means defining the two helical paths.

5. A container closure according to claim 1 wherein the shapes of the blocking member and the cap member are such that when the cap member is rotated on the neck member in a direction tending to unscrew the cap member and with the helical thread engaging the blocked path, the engagement of the top end of the raised helical thread with the blocking member generates substantially no axial forces tending to spring the helical thread axially.

6. A container closure according to claim 3 wherein the shapes of the blocking member and of the plug member are such that when the cap member is rotated on the neck member in a direction tending to unscrew the plug member and with the helical thread engaging the blocked path, the engagement of the stop end of the raised helical thread with the blocking member generates substantially no axial forces tending to spring the helical thread axially.

7. A container closure according to claim 1 wherein the axial force needed to spring the raised helical thread from the free path to the blocked path is considerably smaller than that required to spring it from the blocked path to the next turn of the free path.

8. A container closure according to claim 3 wherein the axial force needed to spring the raised helical thread from the free path to the blocked path is considerably smaller than that required to spring it from the blocked path to the next turn of the free path.

9. A container closure according to claim 1 wherein the helical paths are defined by helical ribs of differing heights each side of the blocked path.

10. A container closure according to claim 3 wherein the helical paths are defined by helical ribs of differing heights each side of the blocked path.

11. A container closure according to claim 1 wherein the neck member is made of rigid material and the cap of resilient plastics material.

12. A container closure according to claim 3 wherein the neck member is made of rigid material and the plug of resilient plastics material.

13. A container closure according to claim 1 and including resilient sealing means to provide a fluid-tight seal when the cap member is screwed firmly on to the neck member.

* * * * *